US009038497B2

(12) United States Patent
Min et al.

(10) Patent No.: US 9,038,497 B2
(45) Date of Patent: May 26, 2015

(54) PEDAL APPARATUS FOR VEHICLE

(71) Applicant: Hyundai Motor Company, Seoul (KR)

(72) Inventors: Jeong Seon Min, Gwangju (KR); Chun Nyung Heo, Gyeongsan-si (KR); Young Eon Jung, Gyeongsan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/288,980

(22) Filed: May 28, 2014

(65) Prior Publication Data

US 2015/0059515 A1 Mar. 5, 2015

(30) Foreign Application Priority Data

Sep. 4, 2013 (KR) ..... 10-2013-0106329

(51) Int. Cl.
*G05G 1/30* (2008.04)
*G05G 1/00* (2008.04)
*G05G 1/44* (2008.04)

(52) U.S. Cl.
CPC ..... *G05G 1/44* (2013.01)

(58) Field of Classification Search
CPC ..... G05G 1/30; G05G 1/40; B60K 2026/026
USPC ..... 74/512–514, 518, 560, 575
See application file for complete search history.

(56) References Cited

U.S. PATENT DOCUMENTS 5,913,946 A 6/1999 Ewing
6,629,472 B2 * 10/2003 Scheidling et al. ..... 74/512
6,689,016 B2 * 2/2004 Apel ..... 477/115
6,877,394 B2 * 4/2005 Massey et al. ..... 74/512
2005/0115354 A1 6/2005 Rinero et al.
2012/0042744 A1 * 2/2012 Han ..... 74/513

FOREIGN PATENT DOCUMENTS

JP 7-20742 A 1/1995
JP 2003-25863 A 1/2003
JP 2003-312304 A 11/2003
KR 10-1997-021947 Y1 6/1997
KR 1020090113401 A 11/2009
KR 10-2010-00101 83 A 2/2010
KR 1020120064346 A 6/2012

OTHER PUBLICATIONS

Machine translation of KR 10-2009-0113401 A obtained on Sep. 3, 2014.*

* cited by examiner

*Primary Examiner* — Thomas R. Hannon
*Assistant Examiner* — Adam D Rogers
(74) *Attorney, Agent, or Firm* — Morgan, Lewis & Bockius LLP

(57) ABSTRACT

A pedal apparatus for a vehicle may include a pad, a bracket which may be disposed below the pad, wherein the bracket may be coupled to the pad and a pedal arm at each opposite end of the pad and the pedal arm, respectively, a link section which may be disposed in the bracket, wherein the link section may be coupled to a lower portion of the pad and an intermediate portion of the bracket, respectively, such that the bracket may be movable in a longitudinal direction thereof, and a hinge-adjusting section which may be disposed above the link section such that an angle of the pad may be adjusted as the link section moves in the longitudinal direction thereof.

13 Claims, 4 Drawing Sheets

PEDAL APPARATUS FOR VEHICLE

CROSS-REFERENCE(S) TO RELATED APPLICATION

The present application claims priority of Korean Patent Application Number 10-2013-0106329 filed on Sep. 4, 2013, the entire contents of which is incorporated herein for all purposes by this reference.

BACKGROUND OF THE INVENTION

1. Field of the Invention

The present invention relates, in general, to a pedal apparatus for a vehicle and, more particularly, to a pedal apparatus for a vehicle, which includes an angle-adjustable pad.

2. Description of Related Art

Generally, if a vehicle is a manual-transmission vehicle it is provided with pedal devices including an acceleration pedal, a brake pedal, and a clutch pedal. In a conventional vehicle, although a pad-angle to suit a driver is different for each driver, depending upon kinds of vehicles or characteristics of drivers' bodies, current vehicles have a fixed pad-angle, so that the pad-angle cannot be adjusted to suit a driver's body.

A prior art discloses an accelerator pedal-actuating device which includes a pedal arm to which a pedal pad is connected at one end, a rotary arm connected to another end of the pedal arm and having a magnet part on a specified region, and a linear motor having, on one end, a rotary roller and a rotary roller shaft supporting the rotary roller, and configured to provide a pedal-depressing force to a driver. The linear motor comes into contact with a certain region of the rotary arm when in passive mode or active mode. The accelerator pedal-actuating device can reach a target pedal-depressing force without error in that the linear motor directly provides the pedal-depressing force in contact with a certain region of the rotary arm.

However, since the linear motor is incorporated into the device in order only to simply provide a pedal-depressing force, the structure becomes complicated and the cost increases, and a pedal cannot be adjusted to suit kinds of vehicles or characteristics of drivers' bodies, thereby providing inconvenience to a driver when driving a vehicle.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a pedal apparatus for a vehicle which is adjustable to suit drivers' body-characteristics or tastes.

In an aspect of the present invention, a pedal apparatus for a vehicle may include a pad, a bracket which is disposed below the pad, wherein the bracket is coupled to the pad and a pedal arm at each opposite end of the pad and the pedal arm, respectively, a link section which is disposed in the bracket, wherein the link section is coupled to a lower portion of the pad and an intermediate portion of the bracket, respectively, such that the bracket is movable in a longitudinal direction thereof, and a hinge-adjusting section which is disposed above the link section such that an angle of the pad is adjusted as the link section moves in the longitudinal direction thereof.

The link section is disposed in the bracket such that an angle of the bracket and the pad is adjusted as the link section moves.

The link section is formed from a circular plate with a predetermined thickness, wherein the plate is made up of a flexible material, and is curved downwards at an angle.

The link section may include a plurality of recesses, each of which extends transversely in parallel and is arranged at regular intervals in the longitudinal direction of the link section.

The recesses are formed in a mating configuration on upper and lower surfaces of the link section such that a region of the link section where the mating recesses are placed on opposite surfaces towards each other form narrow bendable parts at which the link section is curved downwards.

The hinge-adjusting section may include a piped housing, and an upper toothed part which extends downwards along the housing in a longitudinal direction of the housing, wherein the link section may include, on one side thereof, a lower toothed part which extends upwards from an upper surface of the link section, wherein the link section is movable in the longitudinal direction of the vehicle while coupling and decoupling of the upper toothed part of the hinge-adjusting section and the lower toothed part of the link section, such that the pad-angle is adjusted.

The lower toothed part is formed to a predetermined length on the link section in a transverse direction of the link section.

The hinge-adjusting section may further include a central shaft disposed in the housing of the hinge-adjusting section while passing through the housing in the longitudinal direction thereof, an elastic member coiled around the central shaft, an adjusting handle rotatably coupled to the central shaft, and a fixing pin coupling the central shaft to the housing.

The housing may include an opening part cut in a transverse direction thereof, wherein the upper toothed part may have a piped body between the housing and the central shaft, wherein teeth are formed in a protruding manner on a portion of an outer surface of the piped body in a transverse direction of the upper toothed part, and a through opening is formed inside of the opening part, and wherein the size of the through opening is smaller than that of the opening part.

The elastic member is fixed to opposite walls of the through opening at opposite ends thereof so that the upper and lower toothed parts are elastically supported even after the adjusting handle is manipulated.

The adjusting handle is externally mounted to the bracket in a manner as to be exposed to the outside.

The link section is configured such that the link section is moved forward or backward about an engagement portion of the upper and lower toothed parts so as to adjust the angle of the pad when the adjusting handle is rotated to cause the upper and lower toothed parts to be engaged with each other after being moved forward or backward.

The upper and lower toothed parts each may have teeth each shaped into a right-angled triangle having oblique and vertical sides, such that oblique sides of the upper and lower toothed parts are correspondingly engaged with each other.

In the pedal apparatus for a vehicle according to the present invention, a single kind of pedal that can be adjusted in a pad-angle to suit drivers' bodies or tastes is used, thereby satisfying consumer's needs and further increasing working efficiency with unification of working processes.

Further, if required, the pad-angle can be adjusted personally by a driver; can be adjusted in a service center, if a driver is unable to adjust the pad-angle; or otherwise, when the pedal apparatus is manufactured, the pad-angle is previously set to a standard of design for each kind of vehicle, thereby satisfying needs of different levels of customers and therefore providing the effect of improving the brand image of a product.

Thus, the pedal apparatus of the present invention allows the pad-angle of pedals, which are assembled in a factory to have the same specified pad-angle, to be adjusted to suit drivers' bodies or tastes, and driving environment, so that according to a driver's taste or even when the a multitude of drivers drive a single vehicle separately, the pad-angle can be easily adjusted to suit the driver. This configuration enables the pedal apparatus to be adapted to a memory-seat system or the like, thereby providing a customized environment and thus convenience and comfort for each driver.

Further, the same pedal can be incorporated into different kinds of vehicles, accomplishing parts-sharing and thus saving on cost.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
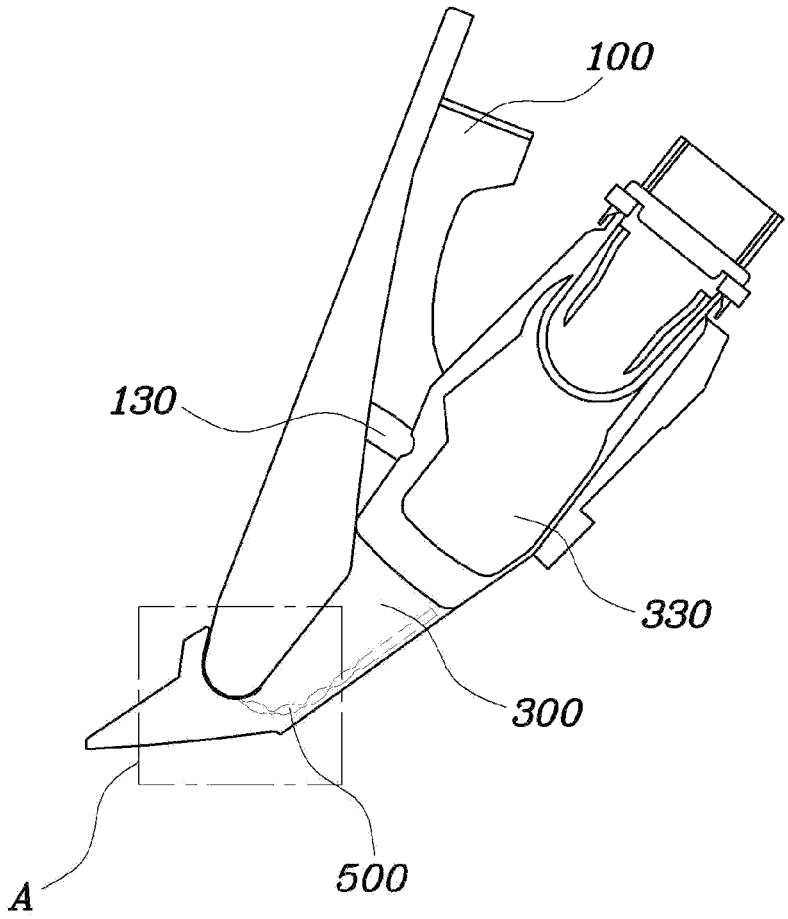
FIG. 1 is a view of a pedal apparatus for a vehicle according to an exemplary embodiment of the present invention when a pad has an increased pad-angle.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a description is made in detail of a preferred embodiment of a pedal apparatus for a vehicle with reference to the accompanying drawings.

Figure 2:
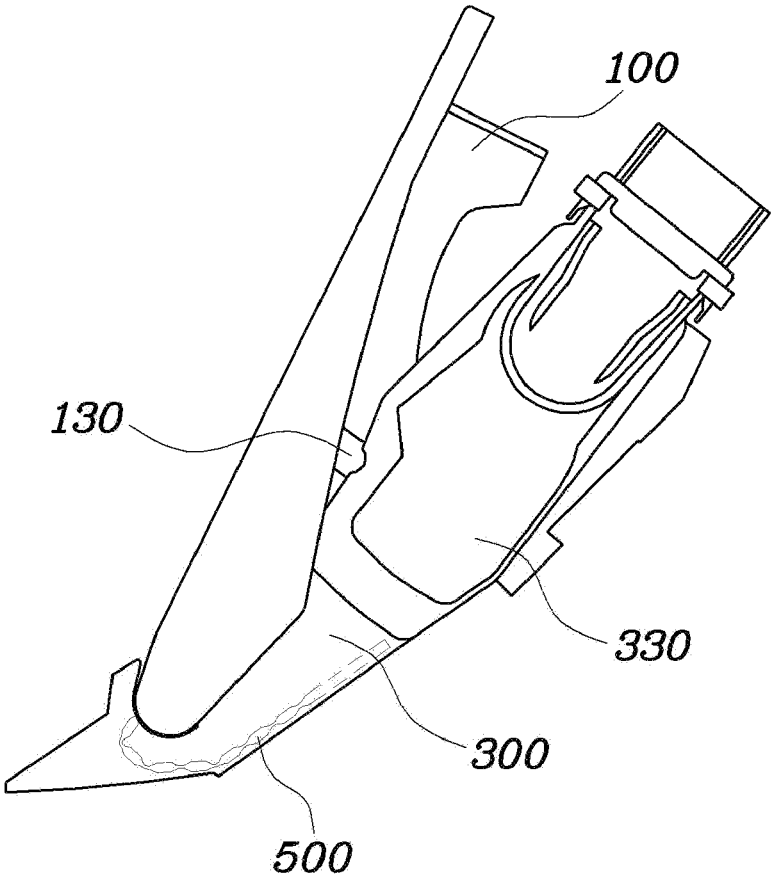
FIG. 2 is a view of the pedal apparatus of FIG. 1 when the pad has a decreased pad-angle.
Figure 3:
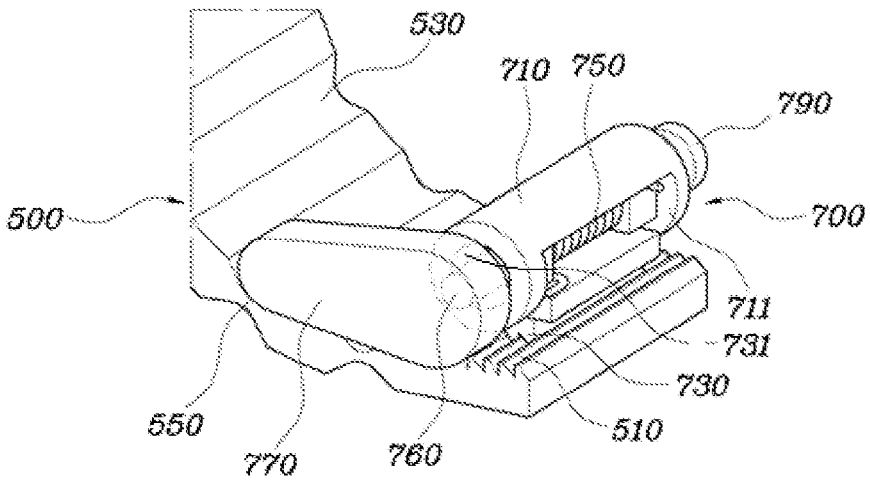
FIG. 3 is a detailed view of section A in FIG. 1.
Figure 4:
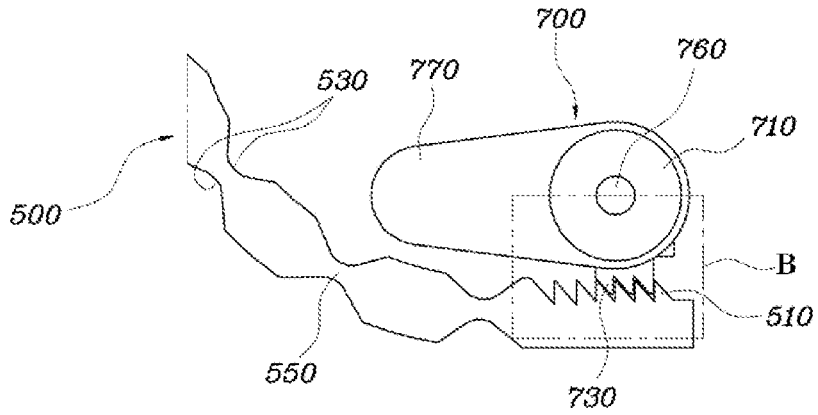
FIG. 4 is a side view of FIG. 3.
Figure 5:
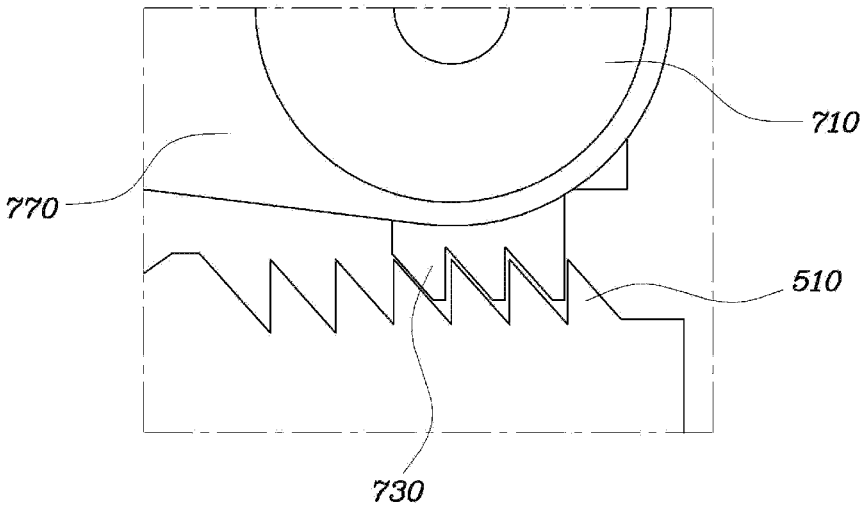
FIG. 5 is a detailed view of section B in FIG. 4.
Figure 6:
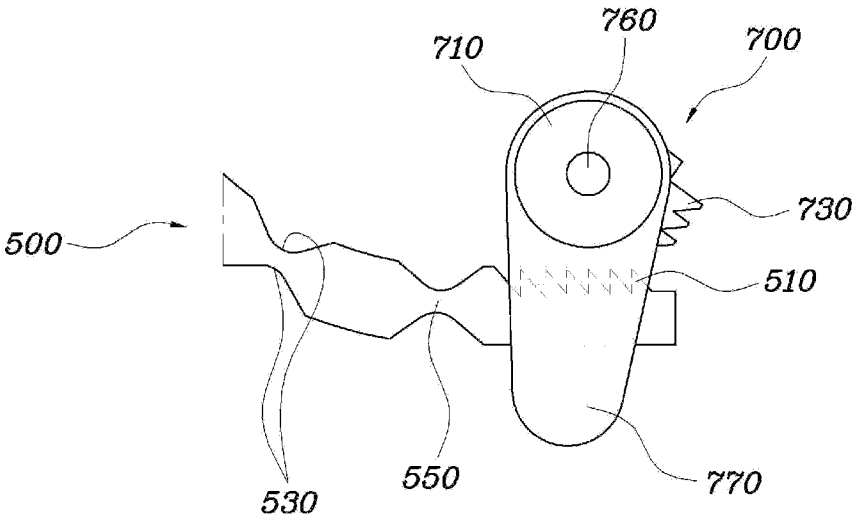
FIG. 6 is a view of a link section when moved back.

FIG. 1 is a view of a pedal apparatus for a vehicle according to an exemplary embodiment of the present invention when a pad 100 has an increased pad-angle, FIG. 2 is a view of the pedal apparatus of FIG. 1 when the pad 100 has a decreased pad-angle, FIG. 3 is a detailed view of section A in FIG. 1, FIG. 4 is a side view of FIG. 3, FIG. 5 is a detailed view of section B in FIG. 4, and FIG. 6 is a view of a link section 500 when moved back.

The pedal apparatus includes a pad 100, a bracket 300 which is disposed below the pad 100 such that it is coupled to the pad 100 and a pedal arm 330 at opposite ends thereof, respectively, a link section 500 which is disposed in the bracket 300 such that it is coupled to a lower portion of the pad 100 and an intermediate portion of the bracket 300, respectively, so that the bracket is able to move in a longitudinal direction thereof, and a hinge-adjusting section 700 which is disposed above the link section 500 such that an angle of the pad 100 is adjusted as the link section 500 moves in the longitudinal direction.

Although the pedal of the pedal apparatus can be adapted to either of a clutch, a brake, and an accelerator, the present embodiment illustrates that the pedal has been adapted to an organ-type pedal to be coupled to a vehicle body at a lower portion thereof.

Under the pad 100, there are the bracket 300, which is coupled to one side of a lower portion of the pad 100, and the pedal arm 330, which is coupled to an upper portion of the bracket. The pedal arm is coupled to the pad 100 via a pedal link 130 so that an operating force of the pad 100 is transferred to the pedal arm 330 through the pedal link 130 as the pad 100 moves. However, unlike in the illustration, the configuration of the bracket 300 and the pedal arm 330 may vary according to design, so for example, the bracket and the pedal arm may be integrally formed into a single unit.

The link section 500 is placed on the bottom of the bracket 300, and is configured to adjust angles of the pad 100, the bracket 300, and the pedal arm 330 while moving in the longitudinal direction below the hinge-adjusting section 700.

The link section 500 may be formed from a circular plate with a predetermined thickness, wherein the plate includes a flexible material, is curved downwards at a certain angle, and is configured to adjust an angle of the pad 100 as the link section 500 moves in the longitudinal direction.

Alternatively, the link section 500 may be formed from a plate with a predetermined thickness, the plate having a multitude of recesses 530 which extend transversely in parallel on the surface of the plate and are arranged at regular intervals.

The recesses 530 may be formed in a mating configuration on opposite surfaces of the link section 500 such that a region where the mating recesses are placed on the opposite surfaces towards each other form narrow bendable parts 550 on the link section at which the link section is curved downwards. Further, the bendable parts 550 may be formed such that the link section 500 is curved downwards to be circular at locations of the bendable parts, so that the link section can adjust the angle of the pad 100 when moving in the longitudinal direction.

Although the recesses 530 are formed on upper and lower surfaces of the link section 500 such that the bendable parts 550 are formed on the link section according to this embodiment, the link section 500 may have any of the above two configurations, or otherwise other configurations based on different design.

The hinge-adjusting section 700 is provided with a piped housing 710 and an upper toothed part 730 which extends downwards along the length of the housing 710. Further, the link section 500 is provided, on one side thereof, with a lower toothed part 510 which extends upwards from the upper surface of the link section. Thus, the link section 500 can move in the longitudinal direction of a vehicle using coupling and decoupling of the upper toothed part 730 of the hinge-adjusting section 700 and the lower toothed part 510 of the link section 500, enabling the pad-angle to be adjusted.

The piped housing 710 may be, but not limited to, an open- or close-ended cylinder or other shaped element.

Although the present exemplary embodiment illustrates that the configuration that allows coupling and decoupling of the link section 500 and the hinge-adjusting section 700 to cause the longitudinal movement of the link section so as to adjust the pad-angle employing the upper and lower toothed parts 730 and 510, the configuration may have other mechanisms according to design for that configuration or a vehicle, in addition to the toothed configuration.

The lower toothed part 510 is formed on a portion of the upper surface of the link section 500 on the end side of the bendable part 550, such that teeth are formed in parallel in a transverse direction of a vehicle. Then, the lower toothed part 510 is engaged with or disengaged from the upper toothed part 730 to cause the movement of the link section 500 in the longitudinal direction of a vehicle, thereby adjusting the pad-angle.

As shown in detail in FIG. 3, a central shaft 760, around which an elastic member 750 is coiled, is mounted in the longitudinal direction, passing through the housing 710 of the hinge-adjusting section 700, and is connected to inner walls of the bracket 300 so as to fix the housing 710 thereto.

The housing 710 is provided with an adjusting handle 770, which is rotatably coupled to the central shaft 760, and a fixing pin 790, which fixes the central shaft 760, at opposite sides, respectively. The fixing pin 790 serves to prevent the adjusting handle 770 from coming out of the central shaft 760 when the adjusting handle 770 is manipulated. Here, the adjusting handle 770 may be fixed to the housing 710 by device of any of other elements in addition to the fixing pin 790, according to design thereof.

Specifically, the upper toothed part 730 of the housing 710 may be formed on the outer surface of the housing 710 in a protruding manner. However, for a smoother operation, the upper toothed part is separately formed in the housing in this embodiment.

The housing 710 of the hinge-adjusting section 700 is provided with an opening part 711 which is cut in a certain length in a transverse direction of a vehicle such that the upper toothed part 730 is formed therein, protruding out of the housing 710. The upper toothed part 730 has a piped body between the housing 710 and the central shaft. A through opening 731 is formed in the opening part 711, wherein the size thereof is smaller than that of the opening part. Teeth are formed on a portion of the outer surface of the piped body such that they protrude along the transverse direction of a vehicle.

With the configuration in which the upper toothed part 730 is formed on the piped body separately provided in the housing 710, when the adjusting handle 770 is manipulated for adjustment of the angle of the pad 100, the upper and lower toothed parts 730 and 510 are elastically and more firmly engaged and operated by device of the elastic member 750.

Further, the elastic member 750, which is coiled around the central shaft 760, is fixed at both sides to opposite walls of the through opening 731, so that the upper and lower toothed parts 730 and 510 are elastically supported thereto even after the adjusting handle 770 is manipulated. Here, the elastic member 750 may be a torsion spring, for example.

The adjusting handle 770 is externally coupled to the bracket 300, being exposed to the outside, so that a driver can easily manipulate the adjusting handle for adjusting the angle of the pad 100.

When the adjusting handle 770 is turned in a clockwise or counterclockwise direction, the link section 500 moves forward or backward to cause the upper and lower toothed parts 730 and 510 to be coupled or decoupled, so that the angle of the pad 100 can be increased or decreased depending upon an amount of the link section 500 being curved.

Here, the teeth of the upper and lower toothed parts 730 and 510 each have a profile of a common triangle or a right-angled triangle, which has oblique and vertical sides, as shown in FIGS. 4 to 6, according to this embodiment, such that the oblique sides of the upper and lower toothed parts 730 and 510 correspondingly engage with each other.

Thus, when the pad-angle is adjusted using coupling and decoupling of the upper and lower toothed parts 730 and 510, the link section is able to move forward in one direction in which the mating oblique sides on the upper and lower toothed parts engage with each other, whereas the link section does not move in the opposite direction in which the mating vertical sides of the upper and lower toothed parts engage with each other. Further, after a driver fixedly sets the angle of the pad 100, the link section 500 is prevented from moving over the hinge-adjusting section 700 in the backward direction, or being decoupled from the hinge-adjusting section.

The operation of the pedal apparatus of the present invention will now be described with reference to FIGS. 4 to 6. First, FIG. 4 shows forward movement (towards the rear side of a vehicle) of the link section 500 for increasing the angle of the pad 100.

In the present embodiment, the oblique sides of the teeth of the upper toothed part 730 are on the left side as seen in the figures, whereas the mating oblique sides of the teeth of the lower toothed part 510 are on the right side as seen in the figures. Naturally, the shape of the teeth and the facing direction of the oblique sides may diversely vary according to design.

In such a configuration of the upper and lower toothed parts 730 and 510, the forward direction is defined as a direction in which the link section 500 moves toward the rear side of a vehicle, whereas the backward direction is defined as a direction in which the link section 500 moves toward the front side of a vehicle.

When a driver increases the angle of the pad 100, the link section 500 should be moved forward about an engagement portion of the upper and lower toothed parts. Here, since all of the mating oblique sides are formed in the direction facing each other, when moved forward, the mating oblique sides engage with each other and slide therealong, so that the link section 500 can be smoothly moved toward the rear side of a vehicle even with a slight force.

Further, since the elastic member 750 is coupled inside of the hinge-adjusting section 700, the link section can be elastically moved forward, and when sufficiently moved forward to form a desired angle, as shown in FIG. 5, the link section is firmly supported so that the upper and lower toothed parts 730 and 510 are not decoupled from each other by device of the elastic force of the elastic member 750.

FIG. 6 shows backward movement of the link section 500. Here, in order to decrease the angle of the pad 100, the adjusting handle 770 is manipulated in a counterclockwise direction such that the upper toothed part 730 is disengaged from the lower toothed part 510, thereby moving the link section 500 toward the front of a vehicle and thus obtaining a decreased angle of the pad 100 according to driver's needs.

The locations of the pad 100 that is moved as described above are shown in FIGS. 1 and 2. In the case of FIG. 1 in which the link section 500 is moved forward about the engagement portion so as to increase an angle of the pad 100, it is advantageous when a distance to the pad 100 is made shorter when a short driver manipulates the pad 100, or active pedal-manipulation is required in the case of operating a sports car or a coupe.

In contrast, in the case of FIG. 2 in which the link section 500 is moved backward about the engagement portion so as to decrease an angle of the pad 100, it is advantageous when a distance to the pad 100 is made longer when a tall driver manipulates the pad 100, or smoother pedal-manipulation is required in the case of operating an SUV or the like.

The above-mentioned angle means an angle between the pad and the flat surface. Thus, increasing angle of the pad approaches 90 degrees with respect to the flat surface, and decreasing angle of the pad approaches zero degrees with respect to the flat surface. Thus, according to an exemplary embodiment of the present invention, a single kind of pedal that can be adjusted in a pad-angle to suit drivers' bodies or tastes is used, thereby satisfying consumer's needs and further increasing working efficiency with unification of working processes.

The pad-angle can be adjusted in a variety of methods. For example, the adjustment may be performed such that after a tool is inserted through the opening part 711 of the housing 710 and pushes up the housing 710 so as to disengage the upper toothed part 730 from the lower toothed part 510 followed by moving the link section 500 in a desired direction, or otherwise the adjustment is manually carried out to have a desired angle by a driver using the adjusting handle 770.

That is, if required, the pad-angle can be adjusted personally by a driver, can be adjusted in a service center, if a driver is unable to adjust the pad-angle, or otherwise, when the pedal apparatus is manufactured, the pad-angle is previously set to a standard of design for each kind of vehicles, thereby satisfying needs of different levels of customers and therefore providing the effect of improving the brand image of a product.

Thus, the pedal apparatus of the present invention allows the pad-angle of pedals, which are assembled in a factory to have the same specified pad-angle, to be adjusted to suit drivers' bodies or tastes, and driving environment, so that according to a driver's taste or even when the a multitude of drivers drive a single vehicle separately, the pad-angle can be easily adjusted to suit the driver. This configuration enables the pedal apparatus to be adapted to a memory-seat system or the like, thereby providing a customized environment and thus convenience and comfort for each driver.

Further, the same pedal can be incorporated into different kinds of vehicles, accomplishing parts-sharing and thus saving on cost.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pedal apparatus for a vehicle comprises:

a pad;

a bracket which is disposed below the pad, wherein the bracket is coupled to an end of the pad and an end of a pedal arm, respectively;

a link section which is disposed in the bracket and adjacent to a rear side of the pad, wherein an end of the link section is continuously coupled to a lower end of the pad and another end of the link section is in an intermediate portion of the bracket, such that the link section is movable in a longitudinal direction of the bracket; and a hinge-adjusting section which is disposed above the link section such that an angle formed between the pad and the bracket is adjusted by the hinge-adjusting section that selectively engages the link section as the link section moves in the longitudinal direction thereof.

2. The pedal apparatus for the vehicle according to claim 1, wherein the link section is disposed in the bracket such that the angle between the bracket and the pad is adjusted as the link section moves.

3. The pedal apparatus for the vehicle according to claim 1, wherein the link section is formed from a circular plate with a predetermined thickness, wherein the circular plate is made up of a flexible material, and the circular plate is curved downwards at an angle.

4. The pedal apparatus for the vehicle according to claim 1, wherein the link section includes a plurality of recesses, each of which extends transversely in parallel and is arranged at intervals in a longitudinal direction of the link section.

5. The pedal apparatus for the vehicle according to claim 4, wherein the recesses are formed on upper and lower surfaces of the link section such that a region of the link section where the recesses are placed on opposite surfaces towards each other form bendable parts at which the link section is curved downwards.

6. The pedal apparatus for the vehicle according to claim 1, wherein the hinge-adjusting section includes:

a pipe-shaped housing; and an upper toothed part which extends downwards along the housing in a longitudinal direction of the housing, wherein the link section includes, on one side thereof, a lower toothed part which extends upwards from an upper surface of the link section, wherein the link section is movable in a longitudinal direction of the vehicle while coupling and decoupling of the upper toothed part of the hinge-adjusting section and the lower toothed part of the link section, such that the angle between the pad and the bracket is adjusted.

7. The pedal apparatus for the vehicle according to claim 6, wherein the lower toothed part is formed to a predetermined length on the link section in a transverse direction of the link section.

8. The pedal apparatus for the vehicle according to claim 6, wherein the hinge-adjusting section further includes:

a central shaft disposed in the housing of the hinge-adjusting section while passing through the housing in the longitudinal direction thereof;

an elastic member coiled around the central shaft;

an adjusting handle rotatably coupled to the central shaft; and a fixing pin coupling the central shaft to the housing.

9. The pedal apparatus for the vehicle according to claim 8, wherein the housing includes an opening part cut in a transverse direction thereof, wherein a through opening is formed in a body portion between the housing and the central shaft to make the body portion be a pipe-shaped body, wherein the upper toothed part has teeth formed in a protruding manner on a portion of an outer surface of the pipe-shaped body in a transverse direction of the upper toothed part, and the through opening is formed inside of the opening part, and wherein the size of the through opening is smaller than that of the opening part.

10. The pedal apparatus for the vehicle according to claim 9, wherein the elastic member is fixed to opposite walls of the through opening at opposite ends thereof so that the upper and lower toothed parts are elastically supported even after the adjusting handle is manipulated.

11. The pedal apparatus for the vehicle according to claim 8, wherein the adjusting handle is externally mounted to the bracket in a manner as to be exposed to the outside of the pedal apparatus.

12. The pedal apparatus for the vehicle according to claim 8, wherein the link section is configured such that the link section is moved forward or backward about an engagement portion of the upper and lower toothed parts so as to adjust the angle of the pad when the adjusting handle is rotated to cause the upper and lower toothed parts to be engaged with each other after being moved forward or backward.

13. The pedal apparatus for the vehicle according to claim 6, wherein the upper and lower toothed parts each have teeth each shaped into a right-angled triangle having oblique and vertical sides, such that the oblique sides of the upper and lower toothed parts are correspondingly engaged with each other.

* * * * *